US007156360B2

(12) United States Patent
Schwörer

(10) Patent No.: US 7,156,360 B2
(45) Date of Patent: Jan. 2, 2007

(54) FORMWORK SYSTEM FOR FORMING TRANSITIONS OF REINFORCEMENT BETWEEN CONCRETE COMPONENTS AND/OR AS TERMINATION OF CONCRETE FORMWORKS

(75) Inventor: Artur Schwörer, Senden (DE)

(73) Assignee: Peri GmbH, Weissenhorn (DE)

( * ) Notice: Subject to any disclaimer, the term of this patent is extended or adjusted under 35 U.S.C. 154(b) by 138 days.

(21) Appl. No.: 10/759,926

(22) Filed: Jan. 16, 2004

(65) Prior Publication Data

US 2005/0029429 A1 Feb. 10, 2005

(30) Foreign Application Priority Data

Aug. 4, 2003 (DE) ..... 103 35 941

(51) Int. Cl.
*E04G 11/12* (2006.01)
*B22D 19/04* (2006.01)

(52) U.S. Cl. ..... 249/33; 249/95; 249/188

(58) Field of Classification Search ..... 249/20, 249/21, 33, 34, 84, 91, 95, 188, 210
See application file for complete search history.

(56) References Cited

U.S. PATENT DOCUMENTS 871,879 A * 11/1907 Middleton ..... 249/91
1,329,095 A * 1/1920 Richardson ..... 249/34
1,517,879 A * 12/1924 Ernest ..... 249/210
2,261,575 A * 11/1941 Ulrich ..... 249/34
2,803,867 A * 8/1957 Martin ..... 249/91
3,197,191 A * 7/1965 Hillard ..... 249/91
3,731,902 A 5/1973 Shoemaker
3,861,096 A * 1/1975 Emmons ..... 249/91
4,106,743 A * 8/1978 Dendinger ..... 249/34
4,116,415 A * 9/1978 Ward ..... 249/188
5,291,713 A 3/1994 Brechbuhler
5,431,368 A * 7/1995 Wilde ..... 249/91

FOREIGN PATENT DOCUMENTS

DE 8705002 U 8/1987

(Continued)

OTHER PUBLICATIONS

Betonwerk + Fertigteil Technik Bauverlag GmbH, "Abschalelement Fuer Fugenband", Wiesbaden, DE., Bd. 63, Nr. 4, Apr. 1, 1997.

*Primary Examiner*—Michael Safavi
(74) *Attorney, Agent, or Firm*—Walter A. Hackler

(57) ABSTRACT

The invention concerns a formwork system (1) for forming a transition of reinforcement (8) between a concrete component and a further concrete component located adjacent thereto in a connecting direction (14), comprising two formwork elements (2, 3) and a central element (5), wherein the central element is disposed between the formwork elements in the region of one end of the formwork elements, and wherein elastic sealing lips (7) are disposed each between the formwork elements (2, 3) and the central element (5), which is characterized in that the formwork system comprises mounting positions (40–43) for spacers (6; 32–39), wherein one mounting position (41, 42) each is provided on the two outer sides, of the central element, facing the formwork elements, and one mounting position (40, 43) each is provided on the inner sides of the formwork elements opposite to these outer sides of the central element, several spacers can be mounted on top of each other at each mounting position, at least one spacer is mounted to each mounting position and one elastic sealing lip is disposed on at least one uppermost spacer (33, 34, 37, 38) of each of the two opposite mounting positions. This permits production of concrete components of any wall thickness and concrete cover depth.

2 Claims, 4 Drawing Sheets

FOREIGN PATENT DOCUMENTS

| | | | |
|---|---|---|---|
| DE | 3810256 | A1 | 6/1988 |
| DE | 198 00 569 | A1 | 7/1999 |
| EP | 0560306 | A1 | 9/1993 |

* cited by examiner

FORMWORK SYSTEM FOR FORMING TRANSITIONS OF REINFORCEMENT BETWEEN CONCRETE COMPONENTS AND/OR AS TERMINATION OF CONCRETE FORMWORKS

BACKGROUND OF THE INVENTION

The invention concerns a formwork system for forming a transition of reinforcement between a concrete component and a further concrete component located adjacent thereto in a connecting direction, or as front side termination of a concrete formwork, comprising two formwork elements and one central element, wherein the formwork elements preferably comprise parallel, flat, vertically oriented formwork shells, wherein the central element is disposed between the formwork elements in the region of an end of the formwork elements, and wherein elastic sealing lips are disposed between the formwork elements and the central element in each case.

DE 198 00 569 C2 discloses a formwork system of this type.

Formwork systems are used to produce concrete components on site. The formwork system delimits to four sides (and to the bottom) a space into which unhardened, liquid concrete is poured. After hardening of the concrete, the formwork is removed and the solid concrete component is released.

The production of larger concrete components, e.g. long walls, requires either correspondingly large formwork systems with a large overall formwork surface, or a principle called "cycling" is used. According to the cycling principle, initially a first section of the large concrete component is produced and when it is hardened, its formwork is dismounted and used to mount a formwork for a second section of the concrete component and so on.

For producing a large concrete component according to the cycling principle, one must observe that no mechanical weak points are introduced into the structure of the entire concrete component at the transition regions or interfaces of the individual sections.

In many applications in building construction, concrete components are provided with reinforcements to improve the stability. Reinforcements are steel structures, in particular core grids or mutually parallel steel rods which are poured into the concrete. A typical building wall has one or two planes of reinforcements which are oriented parallel to the wall surface.

To improve the stability of the concrete component also and especially at the interfaces of neighboring sections, the reinforcements must be continued past the interfaces. This means that the reinforcement must protrude at the end side of the formwork while the concrete is filled in and hardens.

DE 198 00 569 C2 proposes a formwork system for guiding reinforcements at two planes past the front side end of a concrete wall section. Towards this end, the formwork system has two vertical system elements which can be joined e.g. to the front sides of two parallel, opposite, spaced-apart, flat, and vertically oriented formwork elements. The system elements are connected to a central part through tongues, plates and wedges, wherein a gap remains in each case between the system elements and the central part. The reinforcements are guided through the gap. The gap is bridged by elastic sealing lips which tightly abut the reinforcements and provide extensive sealing of the gap against the unhardened concrete.

A disadvantage of this known formwork system consists in that the thickness of the concrete wall which can be produced is fixed by this formwork system. To change the thickness of the concrete wall, at least the central part must be replaced. A further disadvantage is that the depth of the concrete cover of the concrete wall which can be produced, is fixed by this formwork system. The depth of a concrete cover is the distance between the surface and the reinforcement underneath in the inside of a concrete component. The depth of the concrete cover is fixed in the known formwork system by the associated system element. To change the depth of the concrete cover, the associated system element must be replaced in any case. As a result, a specific formwork system according to prior art is suitable for producing exactly only one type of concrete wall at a building site.

In contrast thereto, it is the underlying purpose of the present invention to provide a formwork system for producing concrete components with reinforcement connection, which can be used for concrete components with a plurality of different thicknesses and which can simultaneously be used for a plurality of concrete cover depths.

SUMMARY OF THE INVENTION

This object is achieved by a formwork system of the above-mentioned type which is characterized in that the formwork system comprises: at least four spacers, mounting positions for the spacers, wherein one mounting position each is provided on the two outer sides of the central element, facing the formwork elements, and one mounting position each is provided on the inner sides of the formwork elements, facing the outer sides of the central element, several spacers can be mounted on top of each other at each mounting position, at least one spacer is mounted at each mounting position, and one elastic sealing lip each is disposed on at least one uppermost spacer of two mounting positions facing one another.

The inventive formwork system delimits a space to be filled with liquid concrete by the two formwork elements (which further formwork elements and/or already hardened sections of a concrete component and/or other concrete components may join), the central part, the side surfaces of spacers and at least two elastic sealing lips. The reinforcements may project through the region of the sealing lips which each bridge a gap between the uppermost spacers of two opposite mounting positions.

The separation between the two formwork elements may thereby be determined by the total number of spacers used (at all four mounting positions). When only a few spacers are used, the separation between the formwork elements is adjusted to be smaller thereby reducing the thickness of the concrete wall to be poured, whereas the use of many spacers produces a large thickness. At the same time, the depth of the concrete cover can be selected through selection of the number of the spacers at the mounting position on the inner side of the formwork element on which the associated surface of the concrete component borders.

In this fashion, the inventive formwork system basically produces concrete components of any thickness and concrete covers of any depth through use of a corresponding number of spacers. To produce any type of concrete wall, only two formwork elements, one central element with accessories, and a sufficient number of spacers must be stored at a building side.

In accordance with the invention, different types of spacers may be provided for a lowermost spacer (which directly abuts the formwork element or central element), a spacer disposed between two spacers, and an uppermost spacer (having a sealing lip or being in contact with a sealing lip). Different types of spacers may be provided for use at mounting positions of the formwork elements and at mounting positions of the central element. Moreover, also different types of spacers may be provided for spacers having a sealing lip, being in contact with a sealing lip and without contacting a sealing lip. In accordance with the invention, all spacers without sealing lip are preferably identically formed and the spacers with sealing lip are distinguished from the spacers without sealing lip only by the additional sealing lip which is typically mounted through clamping.

One embodiment of the inventive formwork system is particularly preferred wherein an elastic sealing lip is disposed on each uppermost spacer of each mounting position. This means that the four upper spacers have a sealing lip. The sealing lip is typically produced from rubber, e.g. as rubber hollow section. The sealing lips of those uppermost spacers which are mounted to mutually facing mounting positions are compressed. The two gaps between the spacers are bridged from both sides by contacting sealing lips. The contact between the sealing lips produces a particularly good sealing effect relative to the unhardened liquid concrete.

In a preferred embodiment, the central element has a recess for a tape joint. The recess may also be formed as a clamp gap of the central element. For this reason, a tape joint which is typically produced from rubber, can be integrated in the concrete component as water stop. A moisture path which propagates into the inside of the concrete component at the interface between two sections of a concrete component produced through cycling, is interrupted.

One embodiment of the inventive formwork system is also preferred, wherein the spacers can be mounted in the mounting positions through screw connections. Towards this end, the spacers and the associated counter surfaces of the mounting positions have openings through which a screw can be guided. The penetrated counter surfaces may be provided directly at the central element or directly at the formwork elements, or the central element or the formwork elements have special installations where the penetrated counter surfaces are provided. Vertical sections in the form of independent components are preferably disposed on the formwork elements as special installations, wherein the vertical sections have the penetrated counter surfaces for mounting the spacers. The vertical sections are usually mounted to the formwork elements via turnbuckles. Usually, each set of spacers is fixed to a mounting position with at least two screws and nuts. Screw connections are safe, can be quickly mounted and be quickly removed. To mount different numbers of spacers, screws of different lengths may be provided.

One embodiment is particularly preferred, in which the formwork elements, the central element and the spacers each have an opening, and a common tie rod extends through these openings, wherein the tie rod preferably extends in a horizontal direction perpendicular to the connecting direction. The tie rod accommodates the normal forces which act on the formwork elements through the unhardened concrete and prevents the formwork elements from being forced apart. In this fashion, the tie rod increases the mechanical stability of the formwork system. At the same time, the tie rod fixes the position of the central element and of the inner spacers, and the outer spacers are preferably fixed in position via the vertical section through a turnbuckle.

A preferred further development of this embodiment is characterized in that the formwork elements, the central element and the spacers each have several openings and several common tie rods project through these openings. The use of several tie rods which each penetrate through both formwork elements, the central element and all spacers, still further increases the mechanical stability of the formwork system. In this embodiment, the spacers may be mounted merely by the tie rods.

One embodiment of the inventive formwork system is also preferred, which is characterized in that the central element is formed by two mutually displaceable or pivotable semi-shells, wherein each semi-shell has at least one lug which projects preferably in a vertical direction, the formwork system has also at least one wedge rod, wherein the wedge rod comprises wedge arms for penetration through the lugs, and wherein the wedge arms and lugs interact such that driving forward or backward of the wedge rod moves the semi-shells away from or towards each other, wherein this motion of the semi-shells occurs preferably in a horizontal direction perpendicular to the connecting direction. The wedge rod preferably has wedge arms which are open to the bottom like a horse shoe. The wedge rod and the semi-shells facilitate removal of the central element from a hardened concrete surface. Towards this end, the semi-shells are typically curved at their surfaces contacting the concrete (in particular convexly) or are tilted towards one another in sections.

One embodiment is also advantageous wherein the formwork elements, the central element and the spacers extend in the connecting direction to a common final plane which is perpendicular to the connecting direction. This facilitates orientation of the elements when the formwork is mounted and on the other hand facilitates securing of the elements with respect to the pressure exerted in the connecting direction by the not yet hardened concrete. Securing means can be flatly installed on the final plane in a simple fashion.

In a preferred further development of this embodiment, the formwork system has at least one crossbar which abuts the common final plane, and the crossbar is tensioned with the formwork elements via a stopend tie. The stopend tie is typically formed by a coarse threaded rod which can be secured via butterfly nuts. The crossbar with typically two stopend ties is a simple securing means for accommodating the pressure of the not yet hardened concrete acting on the front side end of the formwork system.

Another advantageous further development of the above-mentioned embodiment provides that the central element is, at least in sections, considerably longer or shorter in the connecting direction than the spacers. Thus, the front side end of the section of the concrete component to be concreted has no flat surface but a profile and/or a curvature. When the central part is longer, the front side of the section to be concreted has a depression, if it is shorter, it has a projection providing a toothing at the interface of two sections of a concrete component erected through cycling. The stability of the entire concrete component is increased by this shear toothing.

One embodiment of the inventive formwork system is also preferred, wherein the spacers have a stepped profile, in particular with an abutment surface which is flat on a first side, and on a second side, has four straight parallel rails, preferably with a hook-shaped rail cross-section. The height of the rails determines the space-keeping effect achieved by the spacer thereby saving material. The cross-sectional hook shape of the rails permits clamping of an elastic sealing lip. The sealing lip is thereby reversibly mounted to the spacer and can be clamped and removed e.g. through guidance parallel to the rail direction. The sealing lip, however, cannot be removed perpendicular to the rail direction and perpendicular to the abutment surface due to the hook effect. The sealing lip preferably abuts partially the side of the abutment surface facing the rails.

Further advantages of the invention can be extracted from the description and the drawing. The features mentioned above and below can be used in accordance with the invention individually or collectively in arbitrary combination. The embodiments shown and described are not to be understood as exhaustive enumeration but have exemplary character for describing the invention.

The invention is shown in the drawing and is explained in the following examples of the invention.

DESCRIPTION OF THE PREFERRED EMBODIMENT

Figure 1:
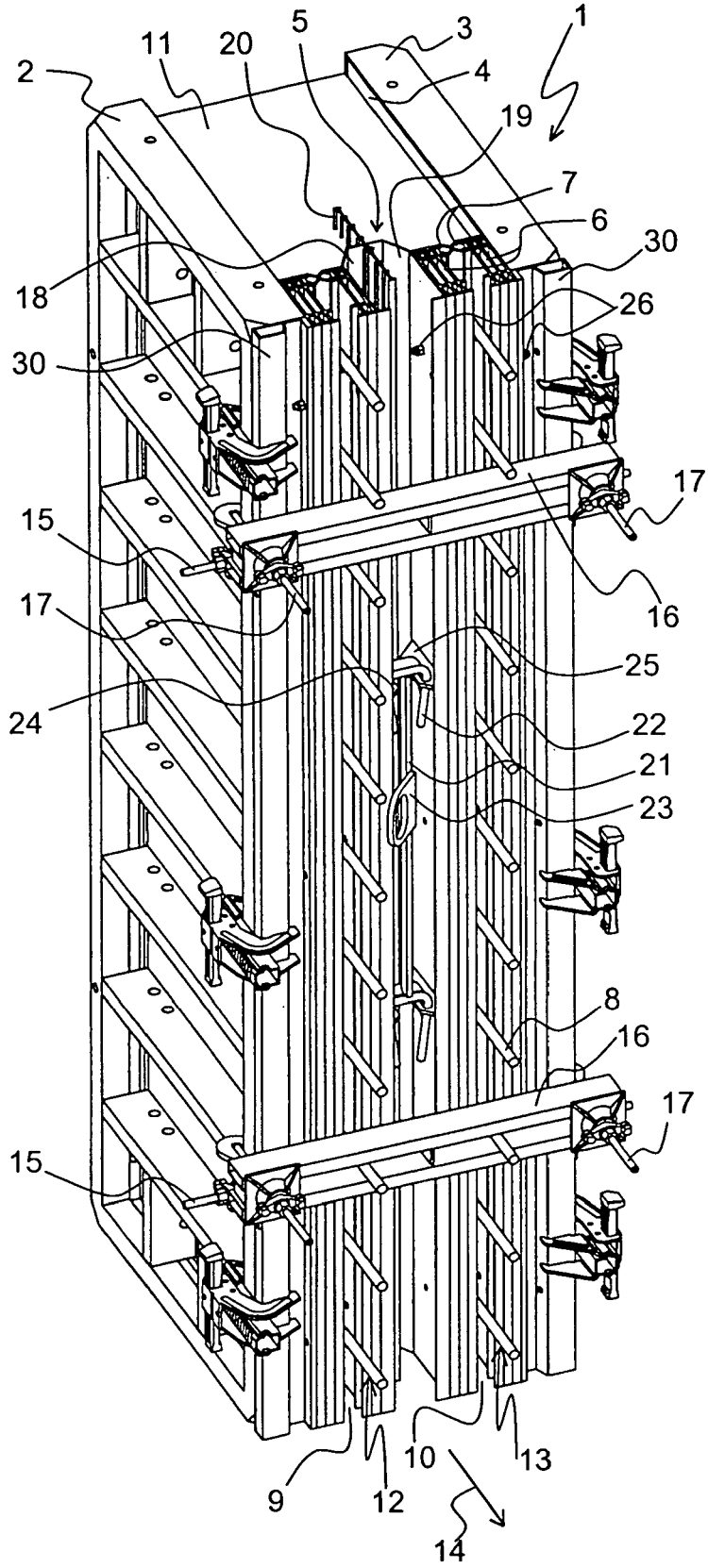
FIG. 1 shows a schematic inclined view of an inventive formwork system using 11 spacers.

FIG. 1 shows an inventive formwork system 1 for producing a transition of reinforcement between two concrete components or two sections of a concrete component which are produced through cycling. The inventive formwork system 1 can, however, also be used as front side termination of a concrete component (without reinforcement).

The formwork system 1 comprises two formwork elements 2, 3 which each have an upright (vertically oriented) formwork shell 4. The formwork shells 4 largely form the inner sides of the formwork elements 2, 3. The formwork system 1 also comprises a central element 5 and a plurality of spacers 6. In FIG. 1, the formwork system 1 has eleven spacers.

The spacers 6 are largely mounted side by side wherein the outermost spacers are mounted to the inner side of the formwork elements 2, 3, and to the outer sides of the central element 5, in each case. The innermost spacers are each provided with one sealing lip 7. The sealing lips 7 of opposite innermost spacers are pressed against each other.

The formwork elements 2, 3, the central part 5, and the spacers 6 with sealing lips 7 delimit a space 11 which is filled with liquid concrete to produce a section of a concrete component to be produced. The formwork system 1 remains in the state shown in FIG. 1 until the concrete in the space 11 is hardened.

The sealing lips 7 are produced from elastic material, preferably rubber or another plastic material. Several reinforcing steels penetrate therethrough. The sealing lips 7 thereby tightly enclose these reinforcements 8. The sealing lips 7 largely close two gaps 9, 10 between opposite sets of spacers 6.

The inventive formwork system 1 permits provision of two planes 12, 13 of reinforcements 8. The reinforcements 8 projecting from the formwork system 1 determine at the same time the direction in which further sections of a concrete component to be produced can join. In the case of FIG. 1, the reinforcements 8 extend parallel to the corresponding connecting direction 14.

To accommodate the pressure exerted by the concrete in space 11 onto the boundaries of the space 11, the formwork system 1 has different reinforcing means or securing means. To hold the formwork elements 2, 3 together, the formwork system 1 has tie rods 15 which penetrate through the formwork elements 2, 3, the spacers 6, the central element 5 and the gaps 9, 10. The tie rods 15 have nuts on both sides which compress the designated elements. To prevent the central element 5 and the spacers 6 from breaking away from the formwork system 1 in the connecting direction 14, the formwork system 1 has two crossbars 16 to which the central element 5 and the connecting elements 6 abut flatly. The crossbars 16 are mounted to the frame of the formwork elements 2, 3 with stopend ties 17.

To facilitate removal of the central element 5 from the hardened concrete after hardening of the concrete in the space 11, the central element 5 is formed by two semi-shells 18, 19. The front edges of the two semi-shells 18, 19, which edges facing space 11, are compressed wherein a waterproof tape joint 20 is disposed in a gap between these edges of the semi-shells 18, 19. The semi-shells 18, 19 are movable relative to each other, wherein the contacting region of the front edges can be regarded as pivot axis. The separation or the pivoting position of the semi-shells 18, 19 relative to each other is determined by the position of a wedge rod 21 which is provided with horse shoe-shaped wedge arms 22. The wedge rod 21 also has a handling bracket 23. The wedge arms 22 penetrate through lugs 24, 25 of the semi-shells 18, 19. The wedge arms 22 are curved such that an upward motion of the wedge rod 21 moves the semi-shells 18, 19 towards each other, and a downward motion of the wedge rod 21 forces the semi-shells 18, 19 away from each other. Before filling in the liquid concrete into the space 11, the wedge rod 21 is forced downwards to spread the semi-shells 18, 19. Spreading produces good closure of the gaps 9, 10. After hardening of the concrete in space 11, the central part 5, in particular the part of the central element 5 projecting into the space 11, is to be released from the surface of the hardened concrete. Towards this end, the wedge rod 21 is pushed upwards thereby pivoting the semi-shells 18, 19 towards each other at their ends facing the observer thereby releasing at least the inclined front edges of the central element 5.

In FIG. 1, the spacers 6 are mounted to vertical sections 30 or to the central element 5 through screw connections 26. Each of these penetrates the set of spacers 6 and the counter surfaces of the respective mounting position at the vertical sections 30 and the central element 5.

Steel is preferably used as material for the formwork elements 2, 3 or their frame structures. Steel is also preferably used for the semi-shells 18, 19 of the central element 5. The spacers 6 are preferably produced from aluminium.

Figure 2:
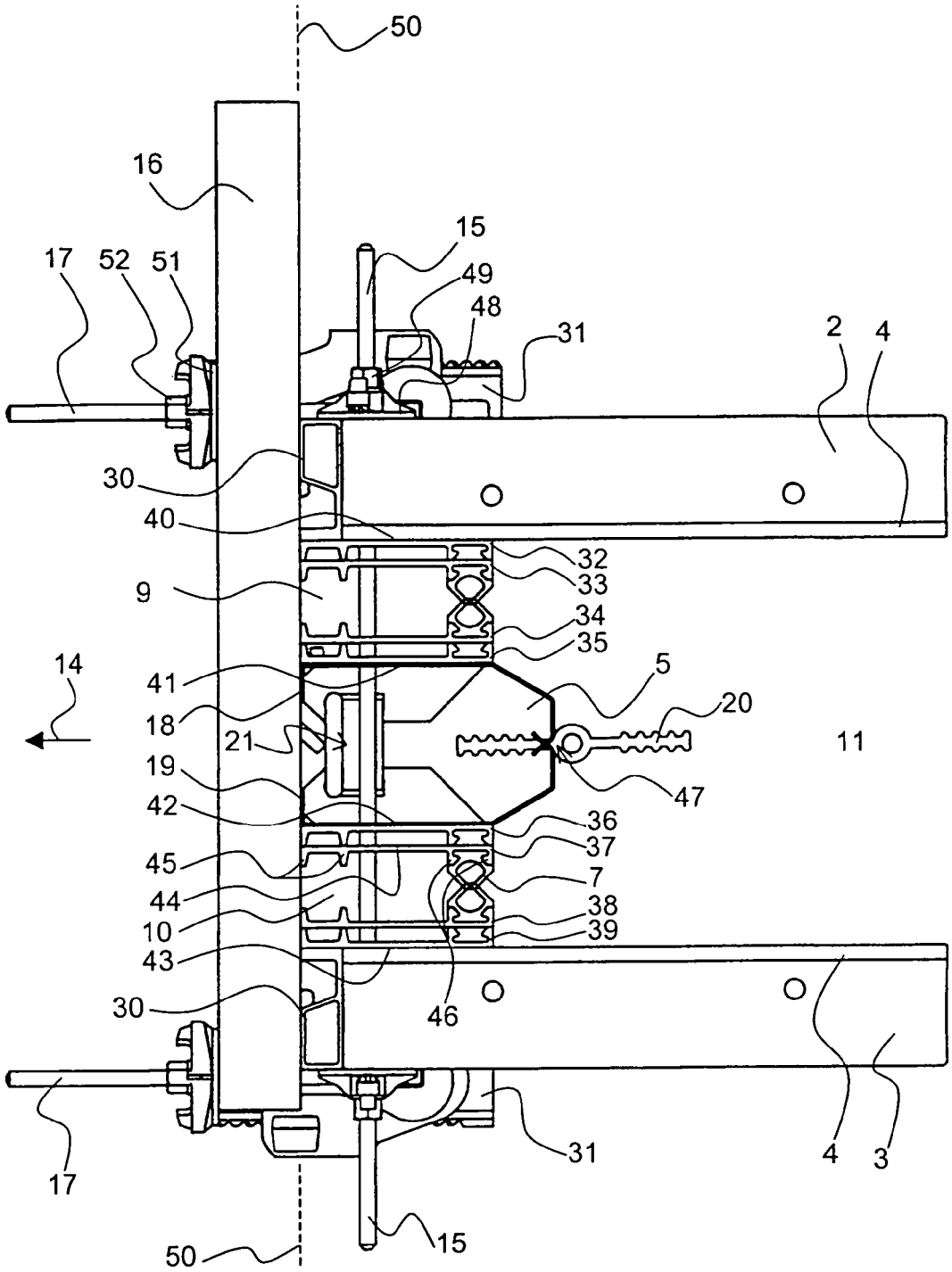
FIG. 2 shows a schematic top view onto an inventive formwork system using 8 spacers.

FIG. 2 shows a top view onto an inventive formwork system, comprising formwork elements 2, 3 which comprise formwork shells 4 and vertical sections 30, wherein the vertical sections 30 are connected through turnbuckle devices 31 to the frames of the formwork elements 2, 3. The formwork system shown also comprises spacers 32, 33, 34, 35, 36, 37, 38, 39 and a central element 5.

The spacers 32, 33 are mounted or next to each other, in a first mounting position 40 in the region of the front side end of the formwork element 2 (left in FIG. 2) on the inner side of the formwork element 2. Two further spacers 34, 35 are opposite to these spacers 32, 33 which are disposed on a second mounting position 41 on an outer side of the central element 5. In a similar manner, the spacers 36, 37 are disposed at a third mounting position 42 on the other side of the central element 5 and the spacers 38, 39 are disposed at a fourth mounting position 43 on the inner side of the formwork element 3. The respectively uppermost spacers 33, 34, 37, 38 each have elastic sealing lips 7, wherein the sealing lips 7 of opposite spacers 33, 34, and 37, 38 are pressed towards each other, i.e. they are under elastic compressive strain. This prevents, in particular, escape of unhardened concrete from a space 11, delimited by the formwork system, through the sealing lips 7. The sealing lips 7 close the gaps 9, 10 between the spacers 33 and 34 and 37 and 38.

The spacers 32 through 39 have flat abutment surfaces 44 formed as plates on which at least two, preferably as shown four rails 45, 46, are disposed on one side. These rails 45, 46 determine the separation bridged by a spacer. At the same time, the rails 45, 46 act as delimitation of the space 11 and as abutment surface to the securing means such as the crossbar 16. A sealing lip 7 can be mounted through clamping to the hook-shaped rails 46. All spacers 32 through 39 are identically formed, in particular spacers with rails (32, 33, 36, 37) on the right-hand side (viewed from the front side) can be transferred through simple rotation to a spacer with rails on the left-hand side (compare 34, 35, 38, 39). In one advantageous embodiment (not shown), the spacers are mirror-symmetrical relative to a vertical central plane which is perpendicular to the connecting direction.

The central element 5 is formed from two semi-shells 18, 19 which border one another at their front edges facing the space 11, in the region 47. The two semi-shells 18, 19 can roll on each other on the round edges in this region 47, i.e. be pivoted relative to each other. In this representation, a tape joint 20 is disposed between the edges in the region 47. Pivoting of the semi-shells 18, 19 relative to each other can be effected through suitable motion of a wedge rod 21 (FIG. 1).

Concrete which is disposed in the region of the space 11 generates pressure on the inner sides of the formwork elements 2, 3 and also on the edges of the spacers 32 to 39 bordering on the space 11, and on the central element 5. These forces must be counteracted by suitable securing means. The forces on the inner sides of the formwork elements 2, 3 are accommodated in particular by a tie rod 15 with counter plates 48 and nuts 49. The tie rod 15 thereby penetrates the formwork elements 2, 3, the spacers 32 through 39, and the central element 5. The forces on the surfaces of the spacers 32 to 39 facing the space 11, and the central element 5 are accommodated by the crossbar 16. This is possible since the spacers 32 through 39 to be secured, and the central element 5 extend in the connecting direction 14 to a common final plane 50 to which they form flat abutment surfaces. The vertical sections 30 also abut the final plane 50. The crossbar 16 is applied to the final plane 50 and is fixed through stopend ties 17 and suitable counter plates 51 and nuts 52.

Figure 3:
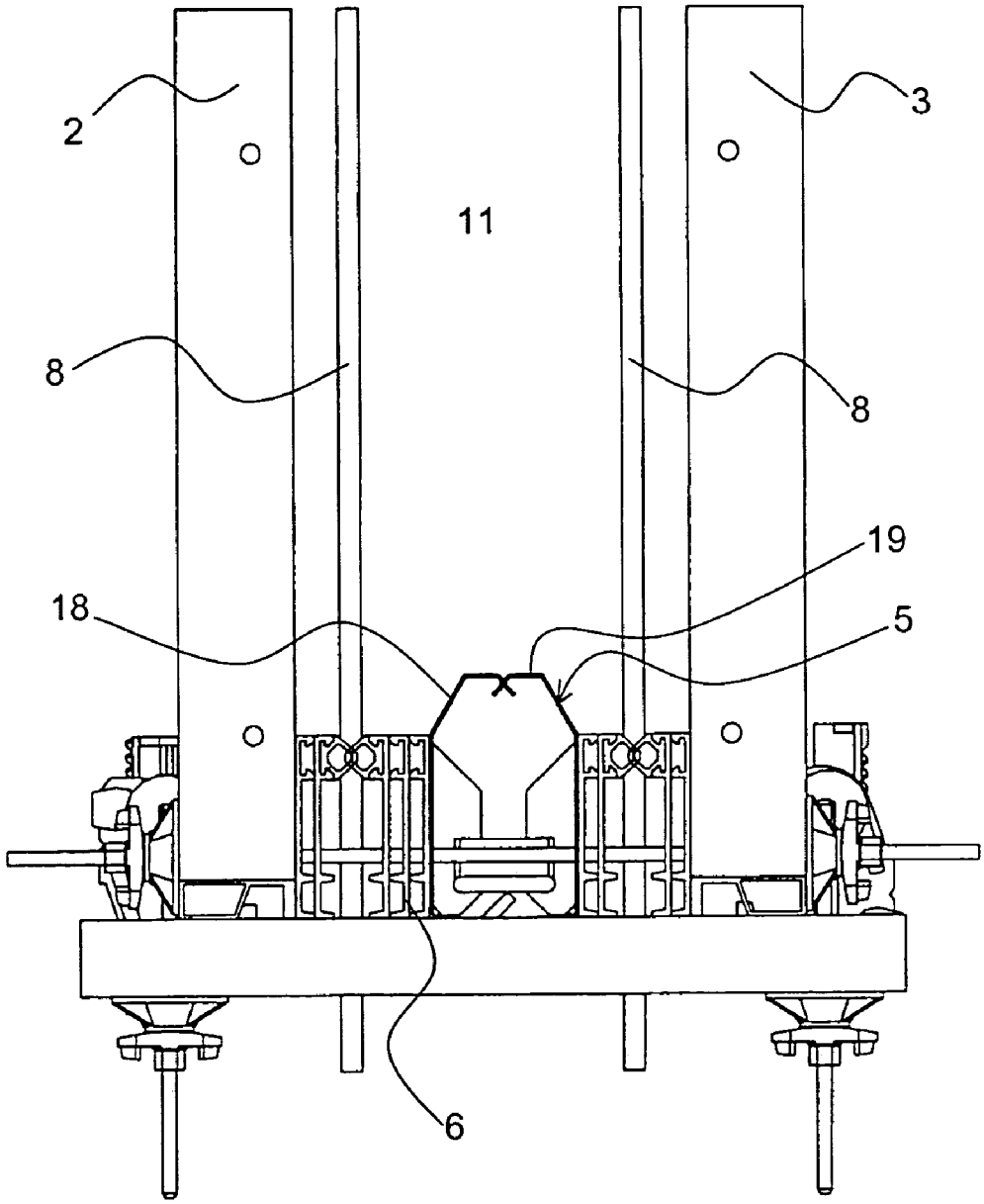
FIG. 3 shows a schematic top view onto an inventive formwork system taking into consideration the reinforcements using 9 spacers.
Figure 4:
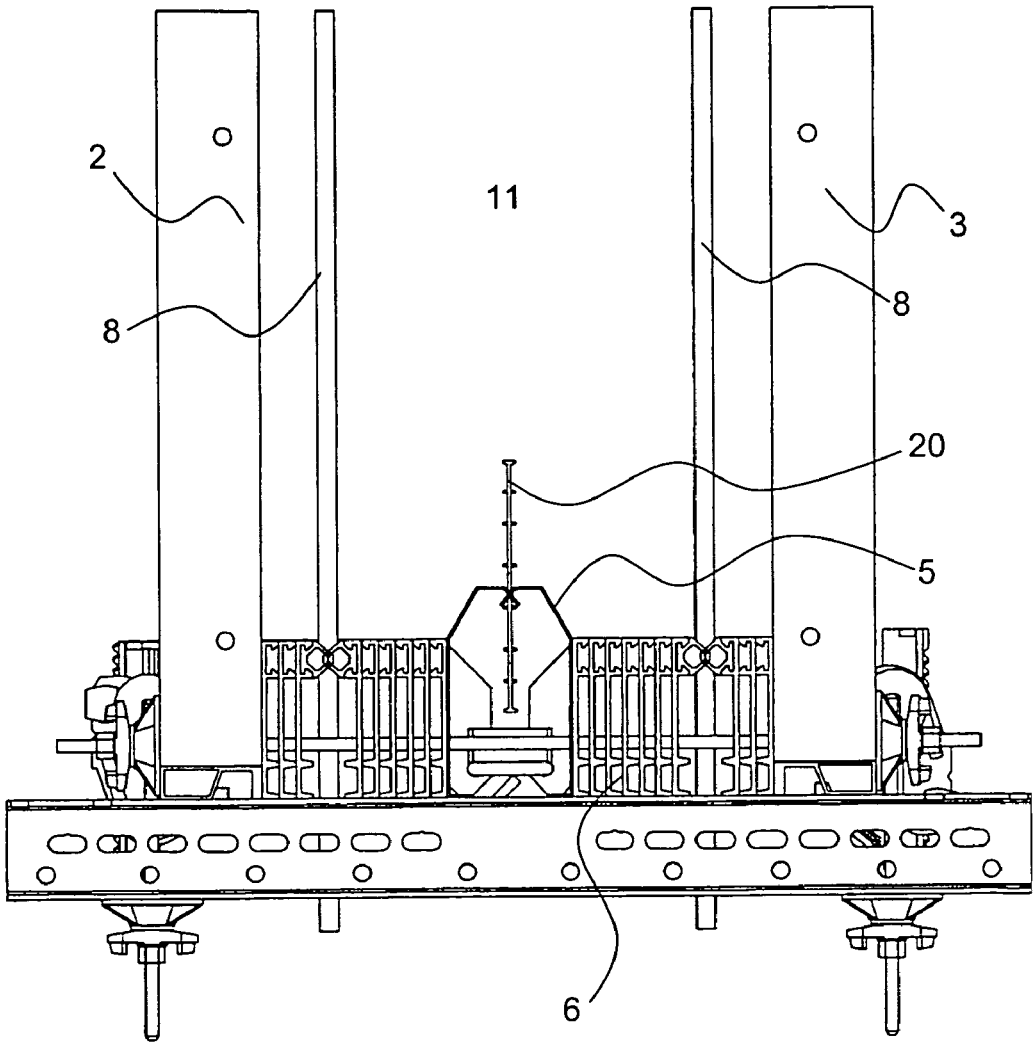
FIG. 4 shows a schematic top view onto an inventive formwork system with reinforcements using 19 spacers and a tape joint.

FIGS. 3 and 4 explain the versatility of the inventive formwork system with respect to the wall thicknesses and concrete cover depths which can be produced.

FIG. 3 shows again a top view onto an inventive formwork system, wherein nine spacers 6 were used. There is a separation between each formwork element 2, 3 and reinforcement 8 which corresponds to approximately the height of two spacers 6. The total thickness of the concrete wall to be poured in the space 11 is composed of the width of the central element 5, the height of nine spacers 6 and two gap widths.

The concrete wall poured into the space 11 is produced without tape joint, wherein a gap between two semi-shells 18, 19 of the central element 5 is kept closed through elastic forces.

FIG. 4 also shows a top view onto an inventive formwork system. In space 11 of this formwork system, a section of a concrete component is produced having a depth of the concrete cover on both sides corresponding to the added height of three spacers 6 and a width which corresponds to the sum of the heights of 19 spacers 6, the width of a central part 5 and two gap widths. The gap widths typically correspond to approximately the diameter of a reinforcement 8. In FIG. 4, the central element 5 also has a tape joint 20.

As is clearly shown in FIGS. 1, 2 and in particular in FIGS. 3 and 4, the depth of the concrete cover and also the overall thickness of a concrete component can be adjusted through adding spacers to the mounting positions or removing them therefrom.

It is generally possible in accordance with the present invention to use non-flat or non-parallel formwork elements. Optionally, a central element with inclined outer surfaces can be used for the corresponding mounting positions. Principally, also formwork elements can be used which are not precisely vertically oriented.

To produce concrete components with particularly thin walls, modifications of the mounting system may be used, wherein no spacer is mounted to one or more mounting positions. If required, sealing lips must be mounted directly to the formwork elements or the central element.

In a concrete component to be poured, reinforcements shall project from the inside of the concrete component past the concrete component to permit rigid connection to a further concrete component to be joined. For the production of the first concrete component, an inventive formwork system is used which comprises two formwork elements with large surfaces which are connected to a central element. The separation between a formwork element and a central element is bridged by a flexible number of spacers which project towards each other in two sets from the inner wall of the formwork element and the outer wall of the central elements in each case. A gap remains between the two sets of spacers which is bridged by at least one elastic sealing lip. A reinforcement which projects out of the concrete component to be poured may force this sealing lip aside, wherein the sealing lip releases a small space for this reinforcement. Besides, the gap remains closed for liquid concrete due to the sealing lip.

I claim:

1. A formwork system for forming a transition of reinforcement between a concrete component and an adjacent concrete component in a connecting direction or to a front side of a concrete formwork, the system comprising:

two formwork elements comprising parallel flat vertically oriented formwork shells;

a central element disposed between the formwork elements proximate at an end of the formwork elements and defining gaps between the central element and the formwork shells, the gaps being disposed on opposite sides of the central element, the central element being formed by two mutually displaceable or pivotable semi-shells wherein each semi-shell comprises at least one lug, each lug being penetrable in a vertical direction;

at least one wedge rod, the wedge rod having wedge arms for passing through the lugs, and wherein the wedge arms and lugs interact such that driving the wedge rod up and/or down moves the semi-shells away from one another or towards one another and, wherein the movement of the semi-shells takes place in a horizontal direction perpendicular to the connection direction;

a plurality of spacers disposed in the gaps and on both the central element and the shells, said spacers being aligned, facing one another and configured for enabling stacking of the spacers on one another; and elastic sealing lips disposed on at least one of abutting spacers for preventing passage of liquid concrete.

2. A formwork system for forming a transition of reinforcement between a concrete component and an adjacent concrete component in a connecting direction or to a front side of a concrete formwork, the system comprising:

two formwork elements comprising parallel flat vertically oriented formwork shells;

a central element disposed between the formwork elements proximate at an end of the formwork elements and defining gaps between the central element and the formwork shells, the gaps being disposed on opposite sides of the central element;

a plurality of spacers disposed in the gaps and on both the central element and the shells, said spacers being aligned, facing one another and each spacer having a stepped profile, with an abutment surface having a flat first side, and having four straight, parallel rails on the second side, the rails having a hook-shaped cross-section; and elastic sealing lips disposed on at least one of abutting spacers for preventing passage of liquid concrete.

* * * * *